United States Patent [19]

Van Breukelen et al.

[11] Patent Number: 4,603,572

[45] Date of Patent: Aug. 5, 1986

[54] DEVICE AND METHOD FOR BENDING CORRUGATED PLATES

[75] Inventors: Jacobus A. T. Van Breukelen; Theodorus Westerveld, both of Soest, Netherlands

[73] Assignee: Dupral B.V., Netherlands

[21] Appl. No.: 610,644

[22] PCT Filed: Sep. 9, 1983

[86] PCT No.: PCT/NL83/00035

§ 371 Date: May 9, 1984

§ 102(e) Date: May 9, 1984

[87] PCT Pub. No.: WO84/00907

PCT Pub. Date: Mar. 15, 1984

[30] Foreign Application Priority Data

Sep. 9, 1982 [NL] Netherlands ..... 8203509

[51] Int. Cl.[4] ..... B21D 13/02

[52] U.S. Cl. ..... 72/385; 72/396; 72/414

[58] Field of Search ..... 72/312, 313, 351, 382, 72/385, 396, 414

[56] References Cited

U.S. PATENT DOCUMENTS

| | | | |
|---|---|---|---|
| 1,556,611 | 10/1925 | Klocke | 72/351 |
| 2,033,667 | 3/1936 | Almdale . | |
| 4,347,726 | 9/1982 | Näslund | 72/385 |

FOREIGN PATENT DOCUMENTS

| | | | |
|---|---|---|---|
| 504467 | 12/1978 | Australia . | |
| 632626 | 12/1961 | Canada | 72/385 |
| 0049313 | 4/1982 | European Pat. Off. . | |
| 1552031 | 12/1969 | Fed. Rep. of Germany . | |
| 2161457 | 6/1972 | Fed. Rep. of Germany . | |
| 1390329 | 1/1964 | France . | |
| 1601215 | 9/1970 | France . | |
| 80/00932 | 5/1980 | PCT Int'l Appl. . | |
| 1573849 | 8/1980 | United Kingdom . | |

*Primary Examiner*—Lowell A. Larson
*Assistant Examiner*—Robert Showalter
*Attorney, Agent, or Firm*—Burns, Doane, Swecker & Mathis

[57] ABSTRACT

A method and an apparatus for bending a corrugated plate about an axis extending transversally to the valleys and crests respectively, by applying said plate between two press beams the opposite faces of which are provided with mutually corresponding and also with the crests and valleys of the plate corresponding alternating raised portions and recesses, and by then bringing the press beams together so as to press inwardly directed ribs into the bottoms of the valleys and pressing outwardly directed bulges into the adjacent sidewalls of said valleys, in such a way that in the first stage, in which the plate as seen in the longitudinal direction of the crests and valleys is supported through a length which is a multiple of the width of the ribs to be formed, the bulges are pressed only, while the ribs are formed in the subsequent stage.

8 Claims, 4 Drawing Figures

DEVICE AND METHOD FOR BENDING CORRUGATED PLATES

The invention relates to a device for bending plates having a corrugated profile, comprising a pair of press beams which are positioned parallel one relative to the other and are mounted to be moved towards and away from each other in transversal direction, said one or lower press beam having at its upper edge a series of alternating recesses and extensions which correspond with the exterior valley profile and interior crest profile respectively of the plate to be bent, while said second or upper press beam has a series of alternating extensions and recesses which correspond with the interior valley profile and the exterior crest profile respectively, and in which on the sidewalls of the recesses in said upper press beam—adjacent the junction of said sidewalls and the bottoms of said recesses—a protuberance is provided adapted to amply engage into a corresponding cut-out in the sidewall of the underlying extension of the lower press beam when the two press beams are brought together, said lower press beam having a punch portion at its upper face extending in the longitudinal direction of said face and adapted to be amply caught in a corresponding longitudinal groove in the lower faces of the recesses of the upper press beam.

More particularly the invention relates to the bending of corrugated sheets, with which the alternating valleys and crests are trapezoide, like a metal coffer dam. Such plates, which are often referred to as plates having a coffer dam profile, are used on a large scale for roofing and cladding purposes.

PCT application No. WO 80/00932 describes a device of the kind above referred to for bending such plates about an axis extending transversally to the valleys and crests, in which by means of said punch portion a series of aligned ribs, extending transversally to the crests and valleys, is impressed from beneath, i.e. towards the crests, into the bottoms of the valleys, while the protuberances on the side faces of the recesses in the operative upper face impress corresponding bulges into the sidewalls of the valleys of the plate in the region adjacent the ends of the ribs in the bottoms of said valleys. In such a way in fact a slight fold (of e.g. 5–10 degrees) is effected in the corrugated feed. By applying a number of such folds along a number of successive parallel folding lines it is possible to bend such a corrugated plate through any desired angle and according to a bending radius whicy may be varied within wide limits.

In practice a disadvantage of this well-known device is found in that there appears a high degree of irregularity with respect to the shape and positioning of the bulges impressed into the sidewalls of the valleys. This irregularity results in a variation of the plate width in the bending zone, while there may be large differences between the ultimate bending angle and the expected bending angle.

Tests have led to the insight, that during the initial phase of the bending procedure, in which the bulges are impressed, the plate is insufficiently supported against undesired movements. During this initial phase the plate is in fact only supported by the relatively narrow punch portion, so that uncontrolled swinging movements may occur about this punch portion.

According to the invention and making use of said insight the above disadvantage is overcome in that the punch portion is movably mounted between an inoperative position, in which said punch portion has its operative upper edge sunk into a groove extending across all of said recesses of the lower press beam, and an operative position, in which the said punch portion has its operative upper edge projecting through said groove upwards beyond the bottoms of the recesses in the lower press beam. Due to the measure according to the invention a device has been obtained, with which the bending peocedure is taking place in two distinct stages, i.e. a first stage, in which the bulges are formed, and a second stage, in which the ribs are formed. During the first stage the punch portion is taking its inoperative retracted position, so that the plate to be bent is then smoothly bearing on the upper faces, bottoms and sidewalls of the projections and recesses of the lower press beam. As a result of this all of the bulges will obtain the same regular shape and a symmetrical position relative to the ribs formed in the second stage.

It is to be remarked that an effective support of the plate in the first stage of the bending procedure can also be achieved when the rib forming portions and the protuberances are provided on the same press beam. A device, with which this is the case, is known from PCT Publication. The consequence of this is, however, that the deformations effected in the bottoms and the adjoining sidewalls of the valleys of the plate will all be directed inwardly, so that the sidewalls of the valleys will be provided with impressions rather than with bulges in case of using the device according to the present invention. As a result of this inacceptable concentrations of tension occur in the junctions between the bottoms and the sidewalls of the valleys of the plate to be bent, while in case of so bending a corrugated plate provided with a covering of plastics material such plate tends to be damaged in the bending areas.

The invention also relates to a method for bending a corrugated plate about an axis extending transversally to the valleys and crests respectively, by applying said plate between two press beams the opposite faces of which are provided with mutually corresponding and also with the crests and valleys of the plate corresponding alternating raised portions and recesses, and by then bringing the press beams together so as to press inwardly directed ribs into the bottoms of the valleys and pressing outwardly directed bulges into the adjacent sidewalls of said valleys, such as disclosed in the above mentioned PCT Publication. The method according to the invention is characterized in that in the first stage, in which the plate as seen in the longitudinal direction of the crests and valleys is supported through a length which is a multiple of the width of the ribs to be formed, the bulges are pressed only, while the ribs are formed in the subsequent stage.

It is to be remarked that for the sake of simplicity in the foregoing it has been started from the situation, in which the two press beams are positioned one above the other. It will be understood, however, that the two press beams may take various alternative mutual positions.

The invention will be hereinafter further explained by way of example with refernce to the accompanying drawings.

Figure 1:
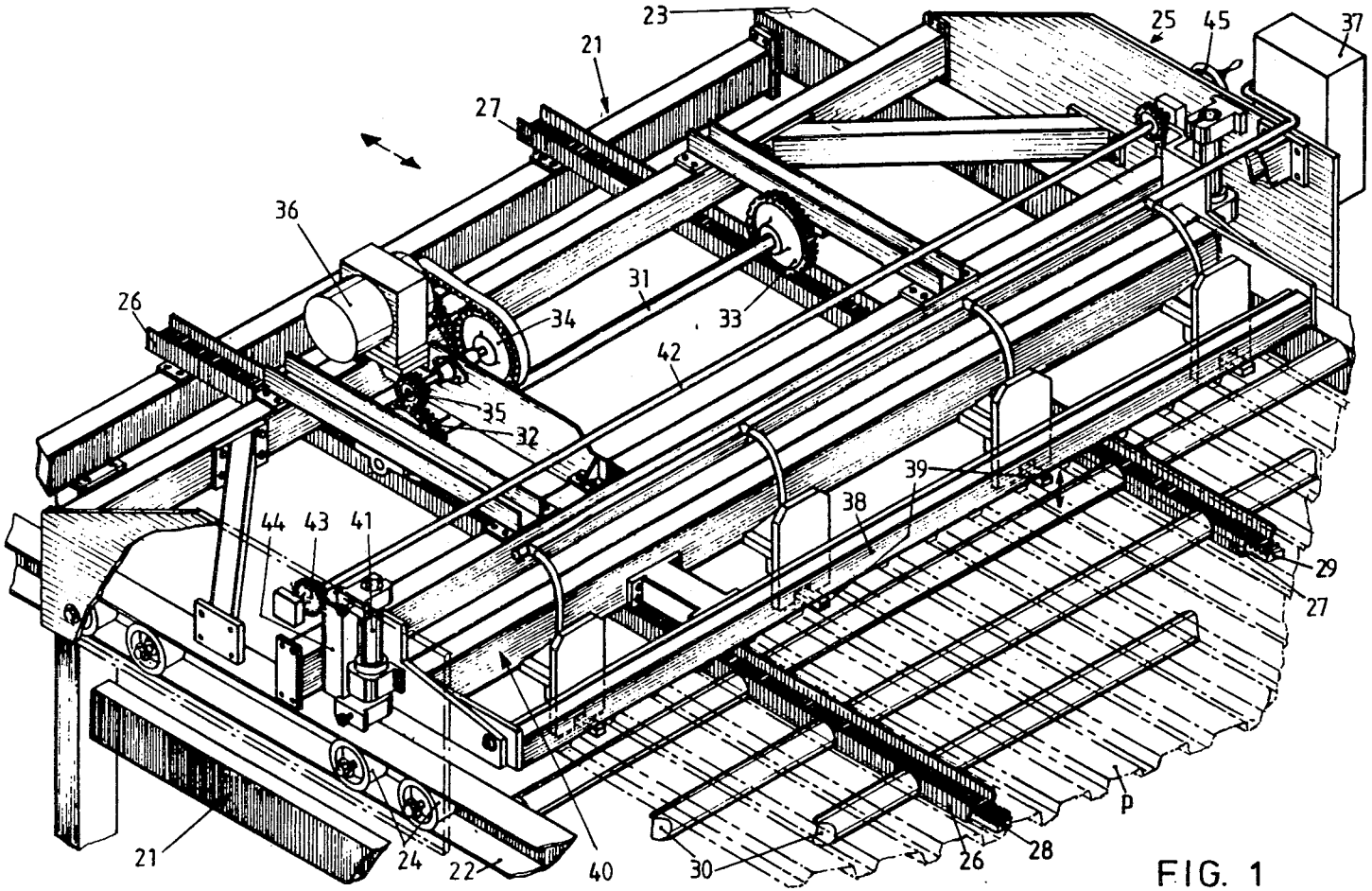
FIG. 1 is a perspective view of a conveyor, by means of which a plate to be bent is fed stepwise through the proper bending device.

The portion of the device according to the present invention shown in FIG. 1 has a frame 21 with a horizontal guide rail 22, 23 extending on either side of it. 25 designates a carriage which is mounted on said frame for a reciprocating movement in the direction of the arrow. The carriage 25 is provided with rollers 24, which are guided by the rails 22 and 23 respectively. The frame 21 further comprises: two beams 26 and 27, mounted between and parallel to the rails 22 and 23. In each of said beams 26 and 27 a toothed rack 28 and 29 respectively is provided. Between the rails 22, 23 and the beams 26, 27 a number of transverse rollers 30 are mounted for free rotation. The rollers 30 constitute a supporting surface for the plate P to be bended, which plate is indicated with dash-dotted lines in FIG. 1. The carriage 25 may be displaced on the frame 21 by means of two gear wheels 32 and 33, mounted on said carriage and interconnected by a shaft 31. Each of said gear wheels cooperates with a toothed rack 28, 29. The gear wheels 32 and 33 may be driven by a motor 36 via a transmission 34 and a gear 35 engaging the gear wheel 32. The motor 36 may be controlled from a control panel 37.

Figures 2, 2A:
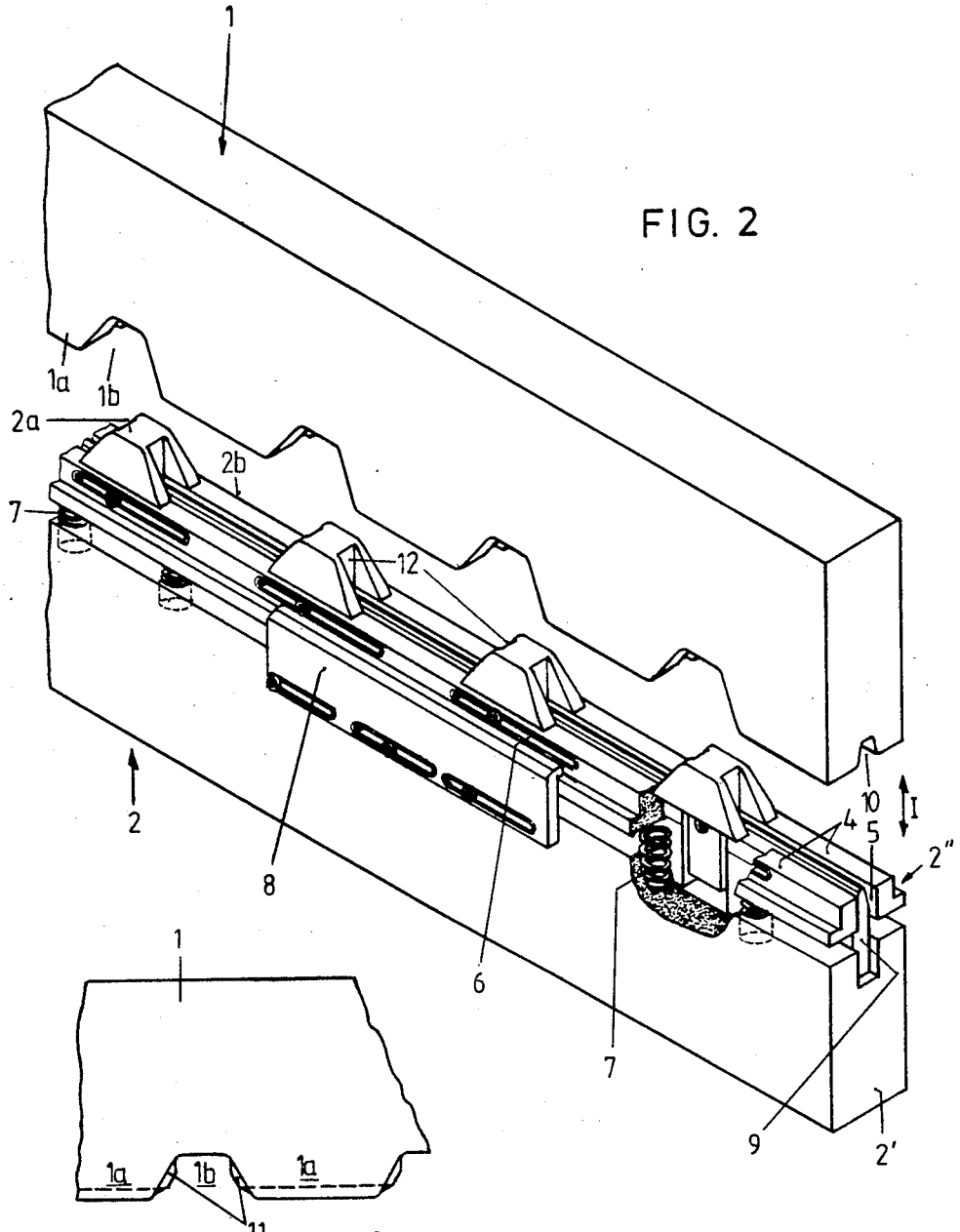
FIG. 2 is a perspective view of the two cooperating press beams of the bending device.
FIG. 2A shows a detail of the upper press beam in FIG. 2.

The carriage 25 is provided with a device for clamping and holding the end of the plate P faced towards the carriage. This device comprises a transversally extending clamping beam 38 and a number of clamping fingers 39, which may be moved relative to the clamping beam in the direction of the arrow so as to clamp the plate to be bent in the crest areas. The clamping beam 38 is making part of a frame 40, which is guided for an up and down movement along guide rods 41 provided on either side of the carriage. By means of said frame 40 the clamping beam 38 can be adjusted to the level of the crests of the plate P. For this purpose a shaft 42 is journalled in the sidewalls of the carriage 25, which shaft carries two toothed wheels 43, which engage toothed racks 44 carried be the frame 40. The shaft 42 may be turned by means of a hand wheel 45. FIG. 2 shows the carriage 25 in its retracted position with respect to the proper bending device, indicated in FIG. 2. In this retracted position of the carriage 25 a plate to be bent may be laid on the supporting rollers 30 and clamped between the clamping beams 38 and the clamping fingers 39. Thereupon the feeding of the plate P towards the bending device may be started.

FIG. 2 only shows the two press beams 1 and 2 of the proper bending device.

This bending device further comprises a frame, which is to be considered as an extension of the frame 21 shown in FIG. 1 and which supports the two press beams 1 and 2 so, that the latter may be moved one with respect to the other in the direction of arrow I. The bending device further comprises the necessary driving equipment for moving and adjusting of the press beams. As these parts of the bending device have no direct relation to the present invention and may be of a well-known construction, they will not be described in detail. For the sake of simplicity reference may be made to the well-known construction disclosed in British patent specification No. 1,573,849. In the embodiment shown in the drawing the upper press beam 1 is constituted by one integral piece. This press beam has, on its face directed towards the lower press beam 2, a number of alternating raised portions and recesses 1*a* and 1*b* respectively, which correspond with the valleys and crests of the corrugated plate P.

The lower press beam 2 has at its upper face a number of alternating raised portions and recesses 2*a* and 2*b* respectively, which correspond with the recesses and raised portions 1*b* and 1*a* respectively of the upper press beam 1.

The lower press beam 2 comprises two sections 2' and 2'', placed one on top of the other, the upper section 2'' of which comprising the raised portions and recesses 2*a* and 2*b* respectively.

The press beam section 2'' is composed of two strips 4, which bound a slot 5 extending along the entire press beam length and are interconnected by the raised portions 2*a* which have been formed as separate bridge pieces. As seen in FIG. 2, the strips 4 are provided with grooves 6, within which the fastening means for the raised portions or bridge pieces 2*a* may be slidingly adjusted so that the press beam section 2' may be adjusted to various profiles of the corrugated plate to be bent by changing and/or sliding of the raised portions or bridge pieces 2*a*. The press beam section 2'' is supported by the lower press beam section 2' by means of compression springs 7. Holding strips 8 (one of which is shown in the drawings only) are provided on either side of the lower press beam section 2', which strips have an upper edge which is bent inwards and engages an outwardly extended flange of the respective strips 4 of the upper press beam section 2''. In this way the holding strips 8 keep the compression springs 7 in a prestressed condition.

A punch 9 extends across the entire length of the press beams and is mounted in a groove in the upper face of the lower press beam section 2'.

In the position shown in FIG. 2, in which the prestressed springs 7 press the upper press beam section 2'' upwardly into the extended position relative to the lower press beam section 2' as determined by the holding strips 8, the punch 9 has its operative upper edge sunk into the groove 5 between the strips 4. Consequently, when the upper press beam section 2'' is pressed downwardly against the action of the springs 7, the punch 9 will project with its operative upper edge above the strips 4. Such a downward movement of the press beam section 2'' may e.g. be effected by moving the upper press beam 1 downwards. By closing the two press beams 1 and 2 in the manner just explained, the upper edge of the punch 9 passing beyond the strips 5 is caught in a corresponding longitudinal groove 10 in the lower face of the upper press beam 1.

As shown in FIG. 2A, the upper press beam 1 is provided with protuberances 11 in the junction areas between the bottoms at adjacent sidewalls of the recesses 1*b*. When the two press beams are closed, these protuberances may amply engage into corresponding cut-outs 12 in the sidewalls of the raised portions or bridge pieces 2*a* of the lower press beam.

Figure 3:
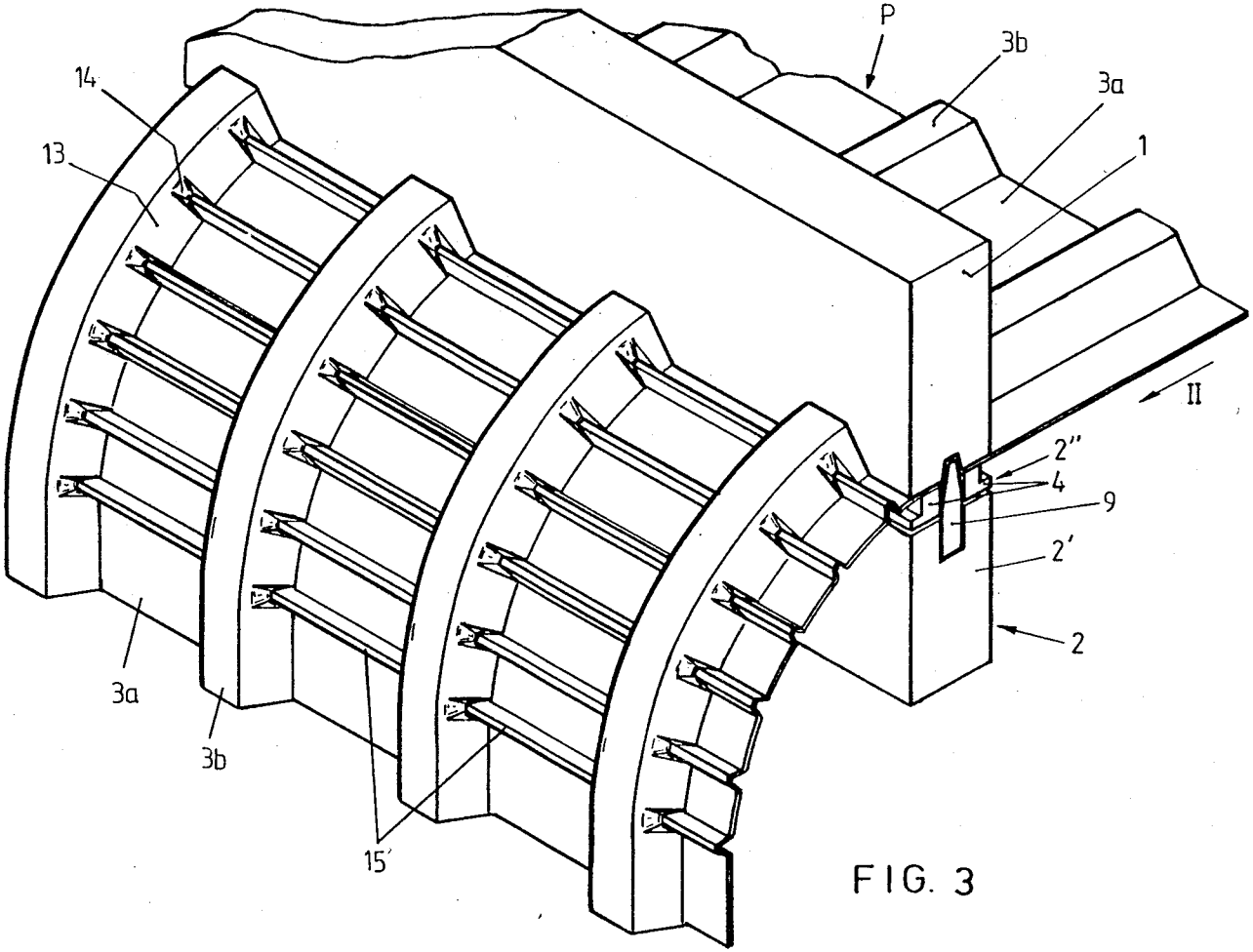
FIG. 3 shows a perspective view of the two press beams and of a corrugated plate therebetween, which has already been subjected to a number of successive bending operations.

In operation the plate P to be bent is fed stepwise, e.g. in the direction of arrow II on the rollers 30 in FIG. 1, between the press beams 1 and 2. Such stepwise feeding may be automatic according to a program which is making part of the control circuitry contained in the control panel 37. In such a program the increments of the stepwise feeding, as well as the stroke of the punch are constituting variable factors, by means of which the size of the bending radius may be determined. FIG. 3 represents the situation in which the plate P, having a usual so-called coffer dam profile, has already been subjected to six bending steps, while the two press beams 1 and 2 are in the process of carrying out the seventh bending step.

It will be clear, that when the two press beams are still "open", the upper section 2'' of the lower press beam 2 will take its positions shown in FIG. 2, in which position the punch 9 is sunk between the two strips 4. In this situation the plate P will be supported in the respective bending regions in a rather stable manner by the entire upwardly directed surfaces of the raised portions and recesses 2*a* and 2*b* respectively of the upper section 2'' of the lower press beam. The pretension of the compression springs 7 is to be selected so, that when closing the two press beams the two sections 2'' and 2' of the lower press beam will initially maintain their mutual position shown in FIG. 2. In this stage only the protuberances 11, pressing the bulges 14 into the sidewalls 13 of the valleys 3*a* of the plate P, will be effected. Only after the upper press beam 1 has arrived in a closed position relative to the upper section 2'' of the lower press beam 2, the final closing movement of the two press beams will put the punch into operation, which will then press a series of upwardly directed ribs 15 in the valleys 3*a*.

The closing movement of the two press beams 1 and 2 may be effected in various members. The lower press beam 2 could be stationary, in which case only the upper press beam would be movable. Conversely the upper press beam could be stationary and the lower press beam be movably mounted. In both cases the bending angle in each individual bending step could be adjusted by adjusting the depth of the ribs 15, which could be realized by selecting the pressure, at which the two press beams are brought together.

Finally it would be posslble to fix the upper section 2'' of the press beam 2 in a stationary position and to actuate the upper press beam 1 and the lower section 2' of the lower press beam one after the other in the closing direction.

We claim:

1. A device for bending plates having a corrugated profile, comprising a pair of press beams which are positioned parallel one relative to the other and are mounted to be moved toward and away from each other in a transverse direction, said one or lower press beam having on its upper edge a series of alternating recesses and extentions which correspond with an exterior valley profile and interior pressed profile respectively, of the plate to be bent, while said second or upper press beam has a series of alternating extentions and recesses which correspond with the interior valley profile and the exterior pressed profile respectively, and in which on the side walls of the recesses in said upper pressed beam, adjacent the junction of said side walls and the bottoms of said recesses, a protruberance is provided to fully engage into a corresponding cut-out in the side wall of the underlying extention of the lower pressed beam when the two pressed beams are brought together, said lower pressed beam having a punch portion at its upper face extending in the longitudinal direction of said face to be fully caught in a corresponding longitudinal groove in the lower faces of the raised portion of the upper pressed beam, wherein the punch portion is moveably mounted between an inoperative position, in which the punch portion has its operative upper edge sunk into a groove extending across all of said recesses of the lower press beam, and an operative position, in which the punch portion has its operative upper edge projecting through said groove upwards beyond the bottoms of the recesses in the lower press beam.

2. A device according to claim 1, characterized in that the lower press beam consists of two sections which are movable one relative to the other, said sections comprising an upper section facing towards the upper press beam and containing the raised portions and recesses of the lower press beam, as well as a lower section facing away from said upper press beam and containing said punch portion.

3. A device according to claim 2, characterized in that the upper section of the lower press beam is supported by said lower section of said press beam by means of springs.

4. A device according to claim 3, characterized in that said springs are pretesioned compression springs, which push said upper press beam section in an extreme position with respect to said lower press beam section, which extreme position is bound by holding strips.

5. A device according to claim 2, characterized in that the upper section of the lower press beam is composed of two strips which bound a slot through which the punch portion may pass upwardly, said strips being interconnected by the raised portions which are formed as separate bridge pieces.

6. A device according to claim 3, characterized in that the upper section of the lower press beam is composed of two strips which bound a slot through which the punch portion may pass upwardly, said strips being interconnected by the raised portions which are formed as separate bridge pieces.

7. A device according to claim 4, characterized in that the upper section of the lower press beam is composed of two strips which bound a slot through which the punch portion may pass upwardly, said strips being interconnected by the raised portions which are formed as separate bridge pieces.

8. A method for bending a corrugated plate defining valleys and crests, about an axis extending transversely to the valleys and crests, including: providing two press beams with mutually arranged opposite faces corresponding to the valleys and crests of the plate, bringing the press beams together with the plate therebetween so as to press inwardly directed ribs into bottom portions of the valleys and to press outwardly directed bulges into adjacent sidewall portions of the valleys, comprising; supporting the plate, in a direction longitudinal to the valleys and crests, through a length which is a multiple of the formed ribs; and, forming the ribs subsequent to forming the bulges.

* * * * *